United States Patent [19]

Otto

[11] Patent Number: 4,638,208

[45] Date of Patent: Jan. 20, 1987

[54] SANDBLASTED INCANDESCENT LAMPS WITH AN IMPROVED NECK SECTION

[75] Inventor: Lee W. Otto, Pepper Pike, Ohio

[73] Assignee: General Electric Company, Schenectady, N.Y.

[21] Appl. No.: 780,065

[22] Filed: Sep. 25, 1985

[51] Int. Cl.[4] ..... H01K 1/32

[52] U.S. Cl. ..... 313/116

[58] Field of Search ..... 313/116, 635, 578, 580

[56] References Cited

U.S. PATENT DOCUMENTS

| | | | |
|---|---|---|---|
| 2,074,888 | 3/1937 | Birdseye | 313/116 |
| 2,084,176 | 6/1937 | Adler, Jr. | 313/116 |
| 2,357,732 | 9/1944 | Ehrlich | 313/116 |
| 2,781,654 | 2/1957 | Pipkin | 313/116 |
| 3,067,352 | 12/1962 | Vodicka et al. | 313/116 |
| 3,209,193 | 9/1965 | Decker | 313/116 |
| 3,384,771 | 5/1968 | Pomfrett | 313/113 |
| 3,847,643 | 11/1974 | Hammer et al. | 313/635 |
| 3,931,536 | 1/1976 | Fohl et al. | 313/116 |
| 4,099,080 | 7/1978 | Dawson et al. | 313/116 |
| 4,256,989 | 3/1981 | Trutner et al. | 313/315 |
| 4,528,617 | 7/1985 | Blackington | 362/339 |

FOREIGN PATENT DOCUMENTS

| | | | |
|---|---|---|---|
| 2160654 | 6/1973 | Fed. Rep. of Germany | 313/116 |

*Primary Examiner*—Stewart J. Levy
*Assistant Examiner*—Hezron E. Williams
*Attorney, Agent, or Firm*—John P. McMahon; Philip L. Schlamp; Fred Jacob

[57] ABSTRACT

Incandescent lamps having an outer envelope with their outer surface sandblasted except at the neck section and the inner surface electrostatically coated are disclosed. The combination of the sandblasting and electrostatic coating provides the incandescent lamp with a diffused light output. The absence of sandblasting at the neck section reduces the breakage of the outer envelope at the region of joinder of the outer envelope to the base of the incandescent lamp.

7 Claims, 5 Drawing Figures

REPRESENTATIVE BULB WALL GRADIENTS DURING HEAT-UP CYCLE

REPRESENTATIVE BULB WALL GRADIENTS DURING COOL-DOWN CYCLE

TYPICAL RESIDUAL STRAIN PATTERN IN THE TENSION BAND REGION

SANDBLASTED INCANDESCENT LAMPS WITH AN IMPROVED NECK SECTION

CROSS REFERENCE TO RELATED APPLICATION

This invention is related to U.S. application Ser. No. 780,059, and filed concurrently herewith.

BACKGROUND OF THE INVENTION

This invention relates to incandescent lamps having enhanced light diffusion developed by an electrostatically coated inner surface of the outer envelope of the lamp cooperating with the outer surface of the outer envelope which is sandblasted except for the neck section of the incandescent lamp.

As is known, it has long been desired to produce a more diffused softer light output from an incandescent lamp developed by an incandescent filament. For example, it is desired to produce an apparently less distinct light output of the incandescent lamp or have it appear that the light output of the incandescent lamp is produced by a distributed light source.

Incandescent lamps for which a more diffused light output is particularly suited are those typically used by a consumer to accommodate reading applications such as the commonly termed three (3)-way lamp and relatively high wattage standard incandescent lamps in the range of about 150 watts to about 300 watts.

A technique for decreasing the apparent intensity of a filament is described in U.S. patent application Ser. No. 780,059 of Susan A. Blau, which is assigned to the same assignee of the present invention. The U.S. patent application Ser. No. 780,059 describes an incandescent lamp having an outer envelope with its inner surface coated with a relatively thick electrostatically deposited light-diffusion coating and substantially all of its outer surface sandblasted or chemically etched so that the combination of light-diffusion coating and sandblasting provides an enhanced light diffusion output of the incandescent lamp.

It has been determined that incandescent lamps of U.S. application Ser. No. 780,059 while serving their desired functions have a limitation with regard to some amount of the incandescent lamps experiencing a breakage at the region where the outer envelope is joined to the electrically conductive base of the lamp. This breakage problem is primarily encountered as in-process losses during the manufacturing of the lamps and are commonly termed infant mortality failures. Major factors to this undesirable breakage is that the sandblasting treatment and residual tension, both on the outer surface of the incandescent lamp, contribute to the breakage.

It is desired that the beneficial contributions of the sandblasted incandescent lamps of U.S. application Ser. No. 780,059 be preserved, but accomplish such sandblasting so as to significantly reduce or even eliminate the undesirable amount of infant mortality breakage experienced in the region of the joinder of the outer envelope to the electrically conductive base of the lamp.

Accordingly, it is an object of the present invention to provide incandescent lamps having diffused light output developed by a light-diffusion coating on the inner surface of the incandescent lamp along with a sandblasted outer surface of the lamp without causing or at least substantially eliminating the breakage experienced in the region of the joinder of the outer envelope to the electrically conductive base of the lamp.

SUMMARY OF THE INVENTION

The present invention is directed to an incandescent lamp having an outer envelope with its inner surface coated with a light-diffusion coating and its outer surface sandblasted in such a manner so as to substantially reduce any breakage in the region of the joinder of the outer envelope to the base of the lamp.

The incandescent lamp comprises at least a major filament mounted on an insulated stem. The incandescent lamp further has an electrically conductive base affixed to the insulative stem and appropriately connected to at least the major filament. The outer envelope has spatially disposed therein the major filament. The outer envelope has a neck section sealed to the electrically conductive base. The outer envelope has an electrostatically deposited light-diffusion coating substantially covering its inner surface. The outer envelope further has its outer surface sandblasted except at the neck section of the outer envelope.

The features of this invention believed to be novel are set forth with particularity in the appending claims. The invention itself, however, as regard to the structure and advantages thereof, may be more readily understood with reference to the following description taken in conjunction with the accompanying drawing.

DETAILED DESCRIPTION OF THE PREFERRED EMBODIMENTS

Figure 1:
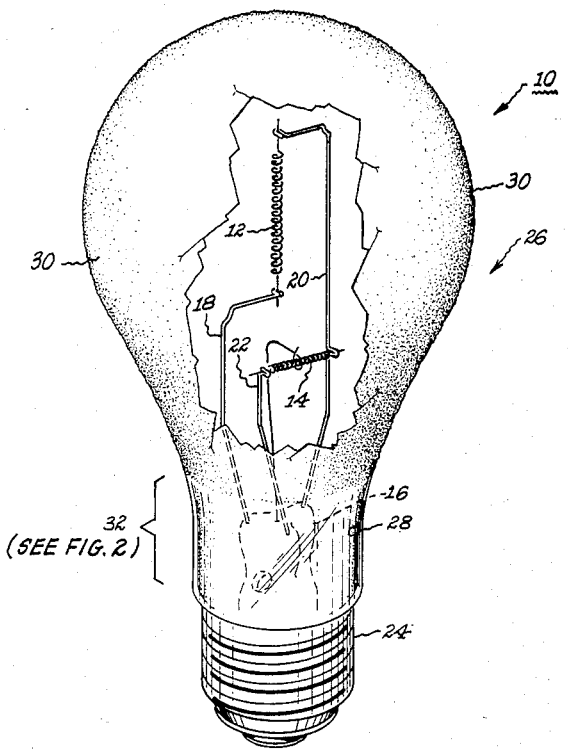
FIG. 1 illustrates one embodiment of the present invention shown as a three (3)-way multi-filament incandescent lamp.

FIG. 1 illustrates a multi-filament three (3)-way incandescent lamp 10 having a major filament 12 and a minor filament 14 in accordance with one embodiment of the present invention. The major and minor filaments of the three (3)-way lamp 10 have wattage values selected to preferably provide three levels of illumination comprising a first level of about 80 watts, a second level of about 170 watts and a third level of about 250 watts. The lamp 10 may also be a standard incandescent lamp having a single or major filament 12 with a wattage rating in the range of about 40 watts to about 300 watts. It is preferred that such a major filament have a wattage rating in the range of about 150 watts to about 300 watts.

The lamp 10 of FIG. 1 has its major filament 12 mounted in an electrically conductive stem 16 by means of electrically conductive members 18 and 20. Similarly, the minor filament 14 is mounted to the electrically conductive stem by means of electrically conductive members 22 and 20. The conductive members 18, 20 and 22 are appropriately connected to an electrical conductive base 24 so as to provide, in the embodiment shown in FIG. 1, three levels of illumination for the lamp 10. The major and minor filaments may be mounted in the manner described in U.S. application Ser. No. 701,821, filed Feb. 14, 1985 of Cho and Lohrey, assigned to the same assignee as the present invention, herein incorporated by reference, and to which reference may be made for further details of such mounting.

The lamp 10 further comprises an outer envelope 26 having spatially disposed therein the one or more mounted filaments 12 and 14. The outer envelope 26 has an electrostatically deposited light-diffusion coating 28 substantially covering its inner surface and which is shown in an enlarged manner in FIG. 1.

The outer envelope 26 has an outer surface 30 which is sandblasted to increase the diffusion characteristic of the outer surface except at the neck section 32 to be described.

As discussed in U.S. application Ser. No. 780,059, the outer envelope 26 having its light-diffusion coating 28 and its sandblasted outer surface 30 provides an enhanced light-diffusion output emitted from the lamp 10 which decreases or softens the apparent intensity typically manifested by the incandescent filaments 12 and 14. The sandblasted outer surface 30 and electrostatically deposited coating 28 each have parameters that are described in U.S. application Ser. No. 780,059 and to which reference may be made for further details.

The lamp 10 of FIG. 1 further comprises the neck section 32 which is absent of any sandblasting and which is of primary importance to the present invention. The absence of any sandblasting at the neck section 32 substantially reduces or even eliminates the breakage of the outer envelope at the region of the joinder of the outer envelope to electrically conductive base discussed in the "Background" section. This elimination may be described with reference to FIG. 2 which is an enlarged cross section of a portion of the neck section 32 showing a representative residual tension and compression diagram related to the region of the incandescent lamp 10 where the outer envelope 26 is sealed to the base 24.

Figure 2:
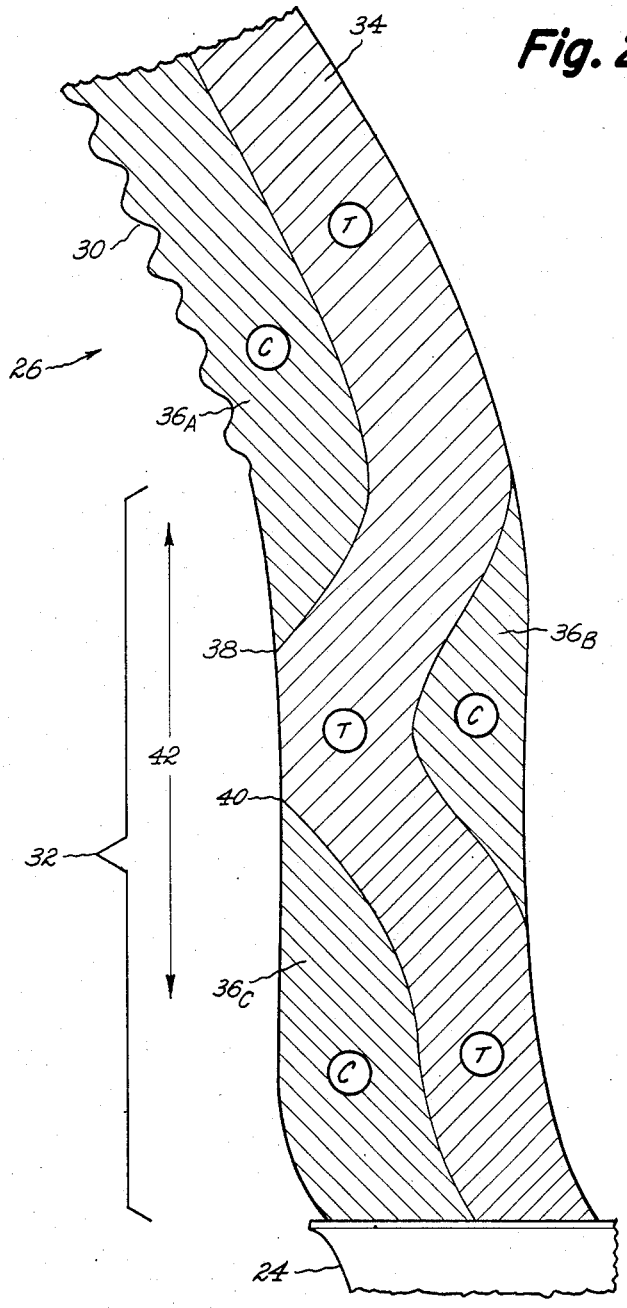
FIG. 2 is an enlarged section showing a representative residual tension and compression diagram related to the region of the incandescent lamp where the outer envelope is sealed to the electrically conductive base of the lamp.

The neck section 32 is shown in FIG. 2 as segmented into a continuous tension band region 34, represented as cross-hatched and indicated by a circled T, and a plurality of compression band regions $\mathbf{36}_A$, $\mathbf{36}_B$, and $\mathbf{36}_C$, represented as double cross-hatched and indicated with an enclosed circle C.

The tension band region 34 is shown in the upper portion of FIG. 2 as being related to inner wall of the outer envelope 26 and being initially occupying substantially the same amount of cross section as compression band region $\mathbf{36}_A$. The tension band region 34 then begins to transition from the inner wall to the outer walls of outer envelope 26 having an exit location 38 and an entrance location 40. The locations 38 and 40 are commonly termed in the glass art as inflection points. The portion of the tension band region 34 touching the outer surface of the outer envelope and within the confines of inflection points 38 and 40 is herein termed an "external tension band." After reaching the outer wall of the outer envelope, the tension band region 34 begins its transition from the outer walls to the inner wall of the outer envelope 26. The tension band region 34 is then shown in the lower portion of FIG. 2 as related to the inner walls of the outer envelope 26 and occupying substantially the same amount of cross section as compression band region $\mathbf{36}_C$.

The portions of the tension band region 34 which are not touching the inner wall of the outer envelope 26 are shown as included in a longitudinal distance 42 having an initial point of approximately 12 mm measured from the uppermost portion of base 24 and a final point of approximately 24 mm also measured from the uppermost portion of base 24.

The compression band region 36A is shown in upper portion of FIG. 2 and extending downward to inflection point 38. The compression band region $\mathbf{36}_C$ initiates at inflection point 40 and extends downward to the base 24. The compression band region $\mathbf{36}_B$ is located in the central portion of the neck section 32, related to the inner wall of the outer envelope 26, and included within the longitudinal distance 42.

The tension and compression regions represented in FIG. 2 were discovered in my pursuit to uncover a solution to the problem discussed in the "Background" section of the outer envelope breakage in the region of the joinder of the outer envelope to the electrically conductive base. I recognized that these tension and compression regions contribute to weakening the outer envelope, in particular, the external tension band resulting from the sealing process of the lamp weakens the outer surface of the outer envelope 26.

Prior to the sealing process, the tension and compression band regions in the neck section are such that one continuous tension band region is located at the inner wall of the outer envelope, whereas, one continuous compression band region is located at the outer wall of the outer envelope. This condition is advantageous in providing structural strength to the outer envelope.

During the sealing process, heat is applied to the outer wall of the outer envelope at the neck section to seal the glass stem 16, shown in FIG. 1, within the confines of the lamp 10. The applied heat to the neck section elevates the temperatures of a portion of the outer and a portion of the inner wall of the outer envelope each above the strain point temperature which allows the release of strains within those portions of the glass of the outer envelope. The strain point temperature is of importance to the present invention and has a typical value of about 760° C. The temperature at which the outer wall is elevated exceeds the temperature at which the inner wall is elevated. When heat is removed from the neck section, the rate of temperature decay of the inner walls of the outer envelope is less than the rate of temperature decay of the outer walls of the outer envelope due to the heat of the outer walls being dissipated to outside ambient and the heat of the inner wall tending to be held inner within the confines of the lamp 10. The unequal elevation of temperature and the different rate of decay of temperature, each related to the inner and outer walls of the outer envelope, create the undesired external tension band and may be described with regard to FIG. 3(*a*), 3(*b*), and 3(*c*).

Figure 3A:
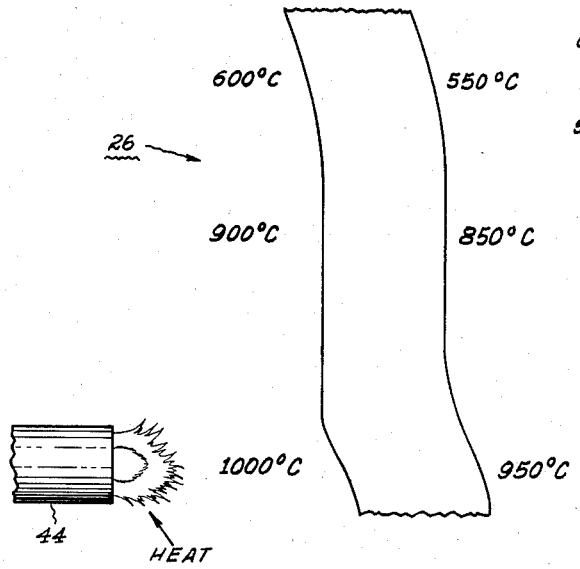
FIGS. 3(*a*) 3(*b*) and 3(*c*) respectively illustrate the representative bulb wall gradients during a heat-up cycle, representative bulb wall gradients during a cool-down cycle, and typical residual strain pattern in the tension band region all related to the present invention.
Figure 3B:
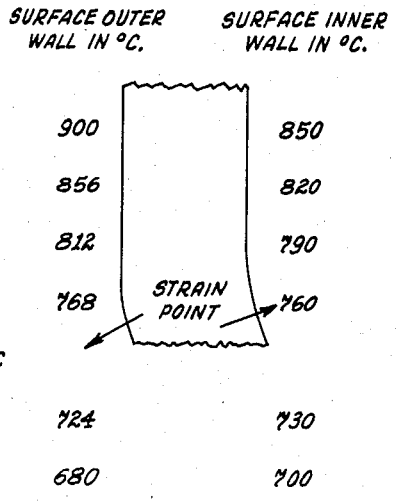
Figure 3C:
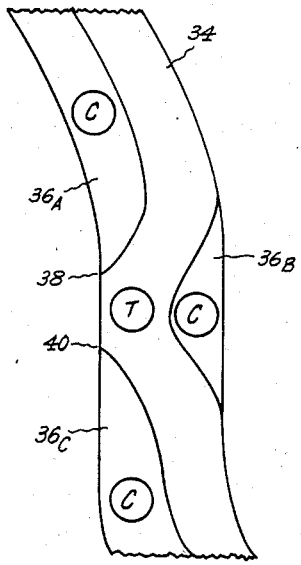

FIG. 3(*a*) illustrates representative bulb wall gradients during a heat-up cycle such as that occurring during the sealing process. When heat, shown by way of a torch 44, is applied to the outer wall of the outer envelope 26 the temperature of the outer wall elevates to a higher temperature, e.g., 1000°-900° C.-600° C. which is respectively greater than that of the inner wall e.g., 950° C.-850° C.-550° C. The temperatures of primary interest to the present invention is shown in FIG. 3(*a*) as 900° C. at the outer wall and 850° C. at the inner wall.

FIG. 3(*b*) illustrates representative bulb wall gradients during a cool-down cycle such as that occurring after the sealing process. The temperature decays related to the temperature of 900° C. at the outer surface of the outer envelope, and 850° C. at the inner surface of the outer envelope are shown in FIG. 3(*b*). When heat is removed from the outer envelope, the 900° C. starts to decay, shown in segments 900° C.–856° C. . . . 680° C. and also the 850° C. starts to decay shown in segments 850° C.–820° C. . . . 700° C. but less rapidly than the 900° C. The temperature of the outer (900° C.) or the inner (850° C.) surface that goes through the strain point temperature (760° C.) first, ends up in a condition of residual compression. From FIG. 3(*b*) it is seen that the temperature of the surface of inner wall first passes through the strain point (760° C.) and then the temperature of the surface of the outer wall passes through the strain point (760°). The effect of such outer and inner surfaces passing through the strain point temperature causes the typical residual strain pattern in the tension band region shown in FIG. 3(*c*).

From FIG. 3(*c*) it is seen that the tension band region 34 while advantageously starting on the inner surface of the outer envelope, then disadvantageously crosses over to the external surface to the points o inflecton 38 and 40 and forms the undesired external tension band, described with regard to FIG. 2.

The tension and compression band regions may be detected by means of a conventional Polyscope. For such detection, the Polyscope is focused on the general area of the neck section and the areas of the tension and compression band regions are exhibited by different colors.

My understanding of the external tension band included within the points of inflections 38 and 40 shown in FIG. 2, led to the solution of the problem of the undesirable amount of breakage of the outer envelope 26 at the region of the joinder to the base 24. More particularly with regard to FIG. 2, I determined that sandblasting of the outer surface within the confines of the points of inflection 38 and 40 acts as a source of pilot cracks, or microscopic flaws, and weakens the outer envelope to such an extent so as to create the condition of fragility leading to the eventual breakage problem. To eliminate breakage this critical area should be void of any sandblasting. Still further, it is preferred that the sandblasting not be accomplished on the outer surface within the confines of the longitudinal distance 40. Moreover, because the diffusion characteristics of the lamp are not substantially effected by the sandblasting of the neck portion, it is preferred that the neck section 24 be void of any sandblasting.

The absence of sandblasting within the confines of the points of inflection, the confines within longitudinal distance 40, and the neck section, may be accomplished by not performing sandblasting within these regions of concern or by appropriate masking of these regions of concern during the sandblasting operation of lamp 10.

In the practice of my invention, 1000 incandescent lamps having the benefits of my invention of a neck section being masked, were subjected to sandblasting of relatively large grit size of 86 microns. The 1000 lamps were then subjected to an environment of 100% relative humidity at a temperature of 100° F. The 1000 lamps having a masked neck section did not experience any problems of the outer envelope breakage at the region of the joinder of the outer envelope to the base.

It should now be appreciated that the practice of the present invention provides for an incandescent lamp having a diffused light output which is provided by sandblasting the outer surface of the outer envelope except preferably at the neck section, in cooperation with an electrostatically coated inner sureface of the outer envelope. The sandblasting is accomplished without causing or at least substantially eliminating the breakage of the outer envelope at the region of the joinder of the outer envelope to the electrical conductive base both of the lamp 10 of the present invention.

What I claim as new and desire to secure by Letters Patent of the United States is:

1. An incandescent lamp comprising:

at least a major filament mounted on an insulated stem;

an electrically conductive base affixed to said insulative stem and appropriately connected to at least said major filament;

an envelope having spatially disposed therein said mounted filament, said envelope having a neck section sealed to said electrically conductive base, said envelope having an electrostatically deposited light-diffusion coating substantially covering its inner surface, and an outer surface which is sandblasted except for the neck section of the outer envelope.

2. An incandescent lamp according to claim 1 wherein said outer surface is sandblasted except for an external tension band region formed by tension and compression forces and located at the outer surface of the neck section of the lamp.

3. An incandescent lamp according to claim 1 wherein said outer surface is sandblasted except for neck section measured from the upper portion of the base in an upward direction to a distance of at least 24 mm.

4. An incandescent lamp according to claim 1 wherein said major filament has a wattage rating of about 40 watts to about 300 watts.

5. An incandescent lamp according to claim 1 wherein said major filament has a wattage rating of about 150 watts to about 300 watts.

6. An incandescent lamp according to claim 1 further comprising a minor filament mounted on said insulator stem and appropriately connected to said electrically conductive base.

7. An incandescent lamp according to claim 6 wherein said minor filament and said major filament each mounted on said insulator stem have wattage values selected to provide three levels of illumination comprising a first level of about 80 watts, a second level of about 170 watts and a third level of about 250 watts.

* * * * *